US005866030A

United States Patent [19]

Reyes-Gavilan et al.

[11] Patent Number: 5,866,030

[45] **Date of Patent: *Feb. 2, 1999**

[54] ENHANCED HYDROCARBON LUBRICANTS FOR USE WITH IMMISCIBLE REFRIGERANTS

[75] Inventors: Jose L. Reyes-Gavilan, Jersey City, N.J.; Alan D. Eckard, Chester, N.Y.; G. Thomas Flak, Pompton Lakes; Todd R. Tritcak, Bayonne, both of N.J.; Leonard Aconsky, New York, N.Y.

[73] Assignee: Witco Corporation, Greenwich, Conn.

[ * ] Notice: The portion of the term of this patent subsequent to Aug. 11, 2015, has been disclaimed.

[21] Appl. No.: 897,371

[22] Filed: Jul. 21, 1997

Related U.S. Application Data

[63] Continuation of Ser. No. 516,399, Aug. 17, 1995, abandoned, which is a continuation-in-part of Ser. No. 426,500, Apr. 20, 1995, abandoned, which is a continuation-in-part of Ser. No. 301,694, Sep. 7, 1994, Pat. No. 5,792,383.

[51] Int. Cl.[6] ..... C09K 5/04

[52] U.S. Cl. ..... 252/68; 508/583; 508/585; 508/588; 508/524; 508/421; 508/388; 417/572

[58] Field of Search ..... 252/68; 508/583, 508/585, 588, 524, 421, 388; 417/572

[56] References Cited

U.S. PATENT DOCUMENTS

| | | | |
|---|---|---|---|
| 3,733,850 | 5/1973 | Olund . | |
| 4,175,047 | 11/1979 | Schick et al. . | |
| 4,219,625 | 8/1980 | Mares et al. | 525/5 |
| 4,397,913 | 8/1983 | Fahey | 428/396 |
| 4,900,463 | 2/1990 | Thomas et al. . | |
| 4,941,986 | 7/1990 | Jolly . | |
| 5,096,606 | 3/1992 | Hagihara et al. . | |
| 5,114,605 | 5/1992 | Mizui et al. . | |
| 5,122,288 | 6/1992 | Shiraishi et al. | 508/497 |
| 5,156,768 | 10/1992 | Thomas et al. . | |
| 5,292,565 | 3/1994 | Napier et al. | 428/36.5 |
| 5,310,492 | 5/1994 | Seiki et al. | 252/68 |
| 5,464,550 | 11/1995 | Sasaki et al. | 252/68 |

FOREIGN PATENT DOCUMENTS

| | | |
|---|---|---|
| 496937 | 8/1992 | European Pat. Off. . |
| 556662 | 8/1993 | European Pat. Off. . |
| 557104 | 8/1993 | European Pat. Off. . |
| 115998 | 5/1989 | Japan . |
| 18491 | 1/1992 | Japan . |
| 125374 | 5/1993 | Japan . |
| 9012849 | 11/1990 | WIPO . |

OTHER PUBLICATIONS

Sanvordenker Ashrae Pub. ISBN 0910110581, pp. 211–216 Jan. 1989, Materials Compatibility of R134a in Refrigerant Systems.

Reyes–Gavilan Ashrae Transaction,pp. 349–360 (1993)—Performance Evaluation of Naphthenic and Synthetic Oils in Reciprocating Compressors Employing R–134a as the Refrigerant (Date Unknown).

*Primary Examiner*—Alan Diamond

*Attorney, Agent, or Firm*—Lockwood, Alex, Fitzgibbon & Cummings

[57] ABSTRACT

Fluid refrigeration compositions comprising a hydrocarbon lubricant, an immiscible refrigerant and an additive capable of reducing the interfacial tension between the hydrocarbon lubricant and refrigerant.

17 Claims, No Drawings

ENHANCED HYDROCARBON LUBRICANTS FOR USE WITH IMMISCIBLE REFRIGERANTS

This application is a continuation of application Ser. No. 08/516,399, filed Aug. 17, 1995 now abandoned, which is a continuation-in-part of Ser. No. 08/426,500 filed Apr. 20, 1995 now abandoned, which is a continuation-in-part of Ser. No. 08/301,694 filed Sep. 7, 1994 now U.S. Pat. No. 5,792,383.

This invention relates to fluid refrigeration compositions comprising a hydrocarbon lubricant, such as mineral oil, a refrigerant immiscible with the hydrocarbon lubricant, and additive capable of reducing the interfacial tension between the hydrocarbon lubricant and the immiscible refrigerant. More particularly this invention comprises a fluid refrigeration composition comprising a hydrocarbon lubricant, such as mineral oil, a fluorohydrocarbon refrigerant immiscible with the hydrocarbon lubricant and a surfactant capable of reducing the interfacial tension between the hydrocarbon lubricant and fluorohydrocarbon refrigerant.

For approximately the past 60 years, chlorofluorocarbons (CFCs) have been commercially used as heat exchange fluids in systems designed for refrigeration and air conditioning applications. These types of compounds have also been employed as propellants, foam blowing agents, and cleaning solvents for the electronics and aerospace industries. CFC-12 (dichlorodifluoromethane), CFC-115 (1-chloro-1,1,2,2,2-pentafluoroethane), and CFC-113 (1,1,2-trichloro-1,2,2-trifluoroethane) are examples of such compounds.

Rowland and Molina hypothesized in the early 1970's that the high stability inherent in CFCs provided these molecules with a very long life in the lower atmosphere. Consequently, they slowly travel to the stratosphere, where chlorine radicals are removed from the CFC molecules by the effect of ultraviolet radiation from the sun. The radicals then attack the ozone found in this atmospheric layer decreasing its concentration. This prompted the aerosol industry in the mid-1970's to gradually replace these chemicals with environmentally safer alternates that met their product specifications.

In the mid-1980's, the detection of a drop in ozone concentration over Antarctica, an effect that is presently spreading to other areas of the globe, has prompted many nations to restrict and eventually ban the production and use of CFCs before the end of the century. Consequently, several compounds have been suggested for use as alternate refrigerants. These compounds belong to the hydrochlorofluorocarbon (HCFC) and hydrofluorocarbon (HFC) chemical families. Examples of HCFCs are R-22 (hydrochlorodifluoromethane), R-123 (1,1-dichloro-2,2,2-trifluoroethane), and R-124 (1-chloro-1,2,2,2-tetrafluoroethane). HCFCs have much lower ozone depletion potentials than do CFCs because even though there is chlorine present in these molecules, they contain hydrogen atoms that cause their decomposition to take place at lower levels of the atmosphere. However, since the depletion of the ozone layer is currently continuing and expanding to other areas of the globe, there is much legislative pressure to eventually restrict and ban these chemicals as well. Hence, these are perceived as short-term refrigerant alternates. Presently used naphthenic mineral oil, alkylbenzenes, and naphthenic mineral oil/alkylbenzene blends have traditionally met the lubricating and performance needs of refrigeration systems charged with HCFCs.

Examples of HFCs are R-134a (1,1,1,2-tetrafluoroethane), R-152a (1,1-difluoroethane), R-32 (difluoromethane), R-143a (1,1,1-trifluorethane), R-125 (1,1,1,2,2-pentafluoroethane), and azeotropic and zeotropic blends consisting of any one of these, or other, HFC components. These molecules are not ozone depleters and hence, have presently been adopted as long term alternate refrigerants. While HFC refrigerants may have desirable physical properties that make them appropriate long term refrigerant alternates, they lack miscibility with naphthenic mineral oils traditionally used as refrigeration compressor lubricants. The mineral oils' chemical stability and miscibility with CFC and HCFC refrigerants, chemical compatibility with all system components, low floc and pour points, high dielectric strength, and proper viscosity provide the properties that enhance their overall performance once charged into the system.

The use of naphthenic refrigeration oils in refrigeration or air conditioning applications where HFCs are employed as refrigerants has been considered by some to be inappropriate due to the immiscibility of both fluids. The belief is that, immiscibility or poor dispersibility between the refrigerant and lubricant at unit operating temperatures may provide unsuitable oil return to the compressor. This causes improper heat transfer due to oil coating of the inner surface of the heat exchange coils, and in extreme cases, lubricant starvation of the compressor. The former causes energy efficiency losses, and the latter results in unit burn-out.

Jolly, et al., U.S. Pat. No. 4,941,986 states that the mixture of the refrigerant and lubricant must be miscible/soluble and chemically and thermally stable over a wide temperature range, covering the operating temperature range of refrigeration and air conditioning systems. It is generally desirable for the lubricants to be miscible/soluble in the refrigerant at concentrations of about 5 to 15% over a temperature range of −40° C. to 80° C. This temperature range brackets the operating temperature of many refrigeration and air conditioning system designs in the market today.

The patentees then disclose replacing the hydrocarbon lubricating oil with various synthetic materials that are much more expensive than the hydrocarbon oils. Obviously, it is economically and environmentally desirable to provide hydrocarbon oil/alternate refrigerant fluids, even though immiscible, for use in these systems.

In American Society of Heating, Refrigerating and Air Conditioning Engineers, Sanvordenker (1989) and Reyes-Gavilan (1993) have independently pointed out that proper oil return is present in household refrigeration systems charged with HFC-134a and straight hydrocarbon oils. Sanvordenker has further explained that this condition is dependent on unit configuration; top-mount units with a horizontal evaporator work well, while side-by-side units with a vertical evaporator function, but not as well. Reyes-Gavilan has shown that by using low viscosity naphthenic mineral oil (70 SUS at 37.8° C.) in the same type of units as those tested by Sanvordenker, the dependence of oil return on unit configuration is eradicated. The agents responsible for oil return in household refrigeration systems, aside from low viscosity mineral oils with good flow characteristics in the system and proper lubrication performance in the compressors, are high refrigerant velocities and short return lines between the evaporator and compressor. It is conceivable that those refrigeration or air conditioning systems with either low refrigerant velocities and/or long return lines between the evaporator and the compressor can experience poor oil return, resulting in any of the aforementioned system performance problems.

Prior art teaching the use of hydrocarbon oils in refrigeration or air conditioning systems employing HFC refrigerants is limited. U.S. Pat. No. 5,096,606 to Kao Corporation, discloses and claims compositions comprising HFCs and polyol esters, which can be blended with other lubricants.

U.S. Pat. No. 5,114,605 to Mitsui Petrochemical discloses a composition comprising a hydrofluorocarbon, polyether carbonate and either a mineral oil or alpha olefin oligomer.

Abstract of Japanese Patent No. 4,018,491 discloses that blends of an ester oil and a hydrocarbon oil such as mineral oil are compatible with hydrofluorocarbon refrigerants wherein the ratio of ester oil to hydrocarbon oil is at least unity.

Abstract of Japanese Patent No. 1,115,998 discloses blends of an alkylbenzene, a mineral oil and a hydrofluorocarbon refrigerant.

Lubrizol PCT WO/12849 suggests using viscosity adjusters such as naphthenic mineral oils. However, no mention is made of improvement in dispersibility or miscibility/solubility characteristics of the hydrocarbon lubricant in the presence of HFC refrigerants.

These references teach those skilled in the art the possibility of using blends comprising hydrocarbon lubricants in HFC refrigeration and air conditioning applications. The industry has noted however; that many hydrocarbon lubricant CFC systems retrofitted to employ HFC/polyol ester fluids have shown performance degradations, indicative of poor oil return to the compressor, when the residual mineral oil content in the polyol ester exceeds 1% of the total lubricant in the system.

For purposes of this invention, the term "immiscible" means that a two-phase system is formed between refrigerant and lubricant, at least at any point in the typical operating range of −40° C. to 80° C. in the refrigeration or air conditioning systems.

The general object of this invention is to provide refrigeration fluid compositions comprising a hydrocarbon lubricant, preferably a mineral oil lubricant, and a refrigerant immiscible with the hydrocarbon lubricant containing at least one carbon and one fluorine atom. A more specific object of this invention is to provide refrigeration fluid compositions comprising a mineral oil lubricant and a hydrofluorocarbon refrigerant immiscible with mineral oil. Other objects appear hereinafter.

We have now found that the objects of this invention can be obtained with refrigeration fluid compositions comprising a hydrocarbon lubricant, a refrigerant immiscible with the hydrocarbon lubricant containing at least one carbon atom and one fluorine atom, and an effective amount of an additive capable of reducing the interfacial tension between the hydrocarbon lubricant and the immiscible refrigerant.

The composition of this invention can be used in refrigeration and air conditioning systems with potential oil return difficulties, when charged with straight hydrocarbon oil and HFC refrigerants. The aim is to facilitate oil return to the compressor by making the refrigerant and hydrocarbon lubricant more dispersible with each other, allowing the refrigerant to wash the lubricant off the inner surfaces of the heat exchangers. The invention provides proper lubrication and energy efficiency to the unit, while maintaining adequate chemical and thermal stability within the system.

Briefly, the refrigeration fluid compositions of this invention comprise a hydrocarbon lubricating oil, a refrigerant containing at least one carbon and one fluorine atom and an additive capable of reducing the interfacial tension between the hydrocarbon lubricant and the refrigerant.

Suitable hydrocarbon lubricants useful in this invention include paraffinic mineral oils, naphthenic mineral oils, alkylbenzene oils, polyalphaolefins and their oligomers, and mixtures thereof. Minor amounts (1 to 20% by wt.) alkylbenzene with major amounts (99 to 80% by wt.) naphthenic mineral oil are particularly useful for improving the solubility or dispersibility of some additives (i.e. surfactants such as 2,4,7,9-tetramethyl-5-decyne-4,7-diol) in the hydrocarbon oil.

Suitable refrigerants useful in this invention include those which contain at least one carbon atom and one fluorine atom. Examples of suitable refrigerants include R-22 (chlorodifluoromethane), R-124 (1-chloro-1,2,2,2-tetrafluoroethane), R-134a (1,1,1,2-tetrafluoroethane), R-143a (1,1,1-trifluoroethane), R-152a (1,1-difluoroethane), R-32 (difluoromethane), R-125 (1,1,1,2,2-pentafluoroethane), and mixtures thereof such as R-404a [R-125 (44 wt. %), R-143a (52 wt. %), R-134a (4.0 wt. %)]. These mixtures can also contain propane as a component of the blend in those applications where the heat exchange fluid is going to be used as an interim retrofit fluid for existing refrigeration and air conditioning equipment. If desired, the suitable refrigerants can be used with CFC refrigerants, particularly, where residual amounts of these refrigerants are present in a system being retrofitted.

The additives useful in this invention for reducing the interfacial tension between lubricant and refrigerant have the property of facilitating the displacement of oil from metal surfaces by the refrigerant. This property can be determined by sealing a refrigerant immiscible at room temperature, such as R134a, with the hydrocarbon lubricant, the hydrocarbon lubricant and additive agents in a glass tube containing a steel or iron chip. A two phase system forms with the lubricating oil constituting the top layer and the refrigerant the bottom layer. The metal chip is then raised up to the oil level in the tube using a magnet and the oil is allowed to completely wet the metal surface by moving the metal chip rapidly up and down in the oil. The additive is suitable for use in this invention, if the refrigerant displaces the oil when the chip is slowly lowered into the liquid refrigerant layer.

Suitable additives include surfactants, such as 2,4,7,9-tetramethyl-5-decyne-4,7-diol sold as Surfynol SE, fluorocarbon esters sold as FC-430, anionic fluorohydrocarbon phosphites, phosphates, carboxylates (salts and acids), sulfonates, etc. such as $F(CF_2CF_2)_{3to8}—CH_2—CH_2SCH_2CH_2CO_2Li$ sold as Zonyl FSA, mixture of $$F(CF_2CF_2)_{3to8}—CH_2CH_2O—\overset{\overset{\displaystyle O}{\|}}{P}(ONH_4)_2 \text{ and}$$

$$[F(CF_2CF_2)_{3to8}—CH_2—CH_2O]_2\overset{\overset{\displaystyle O}{\|}}{P}ONH_4$$

sold as Zonyl FSP, Zonyl FSJ, etc.

In some cases, it can be desirable to enhance the solubility of surfactants in the hydrocarbon lubricants with cosolvents or by using hydrocarbon lubricants made up of two or more components. For example, as indicated above, minor amounts of alkylbenzene hydrocarbons improve the solubility or dispersibility of some additives in mineral oil.

While applicants do not wish to be bound by any theory, applicants believe that the interfacial tension at the refrigerant (liquid)/1GS interface is reduced to the point where the spreading coefficient (S) refrigerant liquid on steel is slightly positive or very close to zero which enables the refrigerant to displace the oil with slight agitation or due to the difference in specific gravity.

The concept of spreading coefficient is defined by: Y=gamma.

$$S=Y_{23}-Y_{12}-Y_{13}$$

Where S is the spreading coefficient of fluid (1) against fluid (2) on the surface of a third phase, (3) a solid. The "Y" terms are the respective interfacial tensions. Spontaneous spreading will occur if S>O. Other influences such as differences in specific gravity or mechanical shear energy also apply, but S will denote the contribution of interfacial tensions as influenced by additives or surface active agents.

1=refrigerant

2=1GS

3=Steel Surface in the case where no additive is present $$O>Y_{23}-Y_{12}-Y_{13}$$

and $Y_{12}$ is a significant positive number as is apparent from the prominent meniscus between the two phases. Also, since the oil preferentially wets and continues to wet the steel even with some degree of agitation;

$$Y_{13}>Y_{23}$$

This leads to the conclusion that $Y_{12}+Y_{13}>Y_{23}$

Upon the addition of certain surfactants, a different behavior results which is described by:

$$0\leqq Y_{23}-Y_{12}-Y_{13}$$

by observation:

$Y_{12}\rightarrow 0$ (flat meniscus)

$Y_{23}\geqq Y_{13}$ (refrigerant displaces oil on steel surface)

This leads to the conclusion that the spreading coefficient for refrigerant on steel approaches 0 or becomes slightly positive, in the presence of certain additives which reduce $Y_{12}+Y_{13}$ faster than $Y_{23}$.

The additive or surface active agent can be used in the range of 0.001 to 5 parts by weight per 100 parts by weight lubricating oil. Concentrates can be prepared containing up to 100 parts by weight surface active agent per 100 parts by weight lubricating oil for purposes of adding same to refrigerating systems containing hydrocarbon lubricating oils containing no surface active agent or insufficient amounts for the desired purpose.

The weight ratio of lubricating oil to immiscible refrigerant can range from 0.10 to 15 parts by weight per 100 parts by weight refrigerant as is conventional in this art.

As indicated above, the industry has noted that many hydrocarbon lubricant/CFC systems retrofitted to employ HFC/polyol ester fluids have shown performance degradations, indicative of poor oil return to the compressor, when the residual mineral oil content in the polyol ester exceeds 1% of the total lubricant in the system. Surprisingly, we have found that the addition of relatively small amounts of polyol ester lubricants to the compositions of this invention improves the solubility or dispersibility of some additives (i.e. surfactants such as 2,4,7,9-tetramethyl-5-decyne-4,7-diol) in the hydrocarbon oil. In such case the weight ratio of polyol ester to hydrocarbon lubricant can range from about 1:99 to 1:3, preferably 1:19 to 1:4.

Accordingly, we believe it is advantageous to retrofit hydrocarbon lubricant CFC systems to employ HFCs by adding concentrate compositions containing polyol ester and surfactant such as 2,4,7,9-tetramethyl-5-decyne-4,7-diol or fluorinated ester directly to the compressor system with or without additional hydrocarbon lubricant provided the surface active agent in the compressor system constitutes at least 0.001 parts by weight per 100 parts by weight of the lubricating fluids in the compressor.

The polyol ester/surfactant concentrate can comprise from about 0.1 to 100 parts by weight surfactant per 100 parts by weight polyol ester.

Suitable polyol esters comprise polyhydric alcohol esters of aliphatic monocarboxylic acids containing 4 to 25 carbon atoms alone or together with di or tricarboxylic acids. Suitable polyhydric alcohols can contain from 2 to 6 hydroxy groups, such as neopentyl alcohol, 1,1,1-trimethylol ethane, 1,1,1-trimethylol propane, pentaerythritol, etc. Suitable aliphatic carboxylic acids include branched and unbranched acids such as butyric acid, isobutyric acid, 2-ethylhexanoic acid, n-octanoic acid, valeric acid, isopentanoic acid, hexanoic acid, heptanoic acid, nonanoic acid, stearic acid, etc. Dicarboxylic acids, such as maleic acid, succinic acid, adipic acid etc. and tricarboxylic acids such as trimellitic acid can be used in small amounts to adjust the viscosity of the polyol ester.

Table I presents suitable stability and wear enhancing additives that may be used with hydrocarbon lubricants employing surface active agents in refrigeration and air conditioning applications with lubricant immiscible refrigerants.

TABLE I

Example of Suitable Additives (Stabilizing and Antiwear)

| Trade Name | Additive Chemical and Functional Characterization | Wt. % |
|---|---|---|
| BHT | Phenolic antioxidant | 0.5 |
| Irganox L-57 | Amine antioxidant | 0.5 |
| Reomet 39 | Triazole derivative copper corrosion inhibitor | 0.5 |
| ERL 4221 | Epoxide | 0.5 |
| Syn-O-Ad 8478 | Triaryl phosphate ester antiwear agent | 5.0 |
| Durad 620B | Phosphate ester antiwear agent | 5.0 |
| Additive RC8210 | Sulfurized extreme pressure agent | 2.5 |

EXAMPLE I

A 9 mL glass tube was charged with 0.050 mL of 70 SUS naphthenic mineral oil (Suniso 1GS) containing 0.5% by weight candidate surfactant, a 6 mm steel chip and 0.70 ml 1,1,1,2-tetrafluoroethane (R-134a) and sealed. A two phase system was formed with the naphthenic mineral oil constituting the top layer and the hydrofluorocarbon the bottom layer. The metal chip was completely wetted with oil by moving the chip rapidly up and down in the oil phase using a magnet. The chip was then slowly lowered into the tetrafluoroethane layer. The results are set forth below in Table II.

TABLE II

| Surface Active Agent | Blend Behavior |
|---|---|
| Diisoamyl (PIB) Succinate | Oil clings to chip. Oil clings to glass. |
| EXP 5159-197 (Fluorinated ester made by Organics) | Improvement in dispersibility but oil clings to chip and glass. |
| Tetrakis (2-ethylhexanol) Pentaerythritol | Oil clings to chip and glass. |
| Surfynol SE | Oil removed from chip and glass by refrigerant. Two layers very dispersible. |
| Surfynol TG | Oil clings to chip and glass. |
| EX 1038 (Carboxylic acid dimer | Oil clings to chip and glass. |

TABLE II-continued

| Surface Active Agent | Blend Behavior |
|---|---|
| ester) | |
| FC-430 | Oil removed from chip and glass by R-134a. Two layers very dispersible. |
| FC-431 | Oil clings to chip and glass. |
| FC-740 | Oil clings to chip and glass. Excessive frothing. |

The above data clearly shows Surfynol SE comprising 2,4,7,9-tetramethyl-5-decyne-4,7-diol and FC-430 comprising a fluorinated ester are suitable for use in this invention.

EXAMPLE II

A 9 ml glass tube was charged with 0.050 ml of 70 SUS naphthenic mineral oil (Suniso 1GS) containing 0.05% by weight candidate surfactant (Surfynol SE or FC-430), a 6 mm steel chip and 0.70 ml 1,1,1,2 tetrafluoroethane (R-134a) and sealed. A two phase system was formed with the naphthenic mineral oil constituting the top layer and the hydrofluorocarbon the bottom layer. The metal chip was completely wet with oil by moving the chip rapidly up and down in the oil phase using a magnet. The chip was then slowly lowered into the tetrafluoroethane layer. For both candidates, the oil is removed from the chip and glass by the R-134a. Both lubricant and refrigerant layers are very dispersible with each other, causing the oil to be removed from the surface of the chip and glass by R-134a.

EXAMPLE III

A multizone pump down solenoid medium temperature supermarket freezer rack in New England, equipped with two five door freezer rack cabinets (each 105.6 $ft^3$), a compressor (Copelametic Model No. R-76 WMT3T) located approximately 6 to 7 ft. off the ground, and evaporators on the floor of each cabinet was retrofitted. The refrigerant gas and oil travel through approximately 20 ft. of ⅞ inch diameter vertical and horizontal suction return lines before arriving at the compressor through a 1⅜ inch tube. The system was charged with R-402A (30 pound charge), which comprised 38 wt. % R125 (pentafluoroethane), 60 wt. % R22 (hydrochlorodifluoromethane), and 2 wt. % R290 (propane) and a 200 SUS alkylbenzene lubricating oil containing antiwear and foaming agents. As the unit operated below −5° F., the lubricant level in the compressor went down and the oil pressure switch turned off the unit. The system was then operated at about 0° F. to maintain proper oil pressure and lubrication.

The oil was drained from the system leaving some residual alkylbenzene; charged with 150 SUS oil comprising primarily naphthenic mineral oil, 10 wt. % alkylbenzene, and 0.05 wt. % Surfynol SE; evacuated for ½ hour and allowed to run for 1 hour to flush residual alkylbenzene oil from the system. During this time, the oil pressure switch did not go off and −17° F. and −10° F. temperature were attained for the respective racks. After 1 hour, the oil was drained again from the system and replaced with fresh 150 SUS oil comprising primarily naphthenic mineral oil, 10 wt. % alkylbenzene, and 0.05 wt. % Surfynol SE. Both freezers have been operated for two months at −10° F. to −15° F. with no oil return difficulties.

EXAMPLE IV

The compositions listed below in Table III have been tested with R-134a and 2,4,7,9-tetramethyl-5-decyne-4,7-diol surfactants with encouraging results. In the Table, H-1 stands for a 12 cSt naphthenic mineral oil at 40° C., H-2 stands for a 38 cSt white naphthenic mineral oil at 40° C., H-3 stands for a 29 to 30 cSt naphthenic mineral oil at 40° C., H-4 stands for an 18 cSt naphthenic mineral oil at 40° C., H-5 stands for 29 to 30 cSt alkylbenzene at 40° C., P1 stands for a polyester of trimethylol propane, 70% valeric acid and 30% isovaleric acid, P2 stands for a polyester of pentaerythritol and 2-ethylhexanoic acid and P3 stands for a polyester of pentaerythritol, valeric acid, isovaleric acid and adipic acid.

TABLE III

| Lubricants in parts by weight | Surfactants in parts by weight |
|---|---|
| 99.95 H-1 | .05 |
| 91.90 H-1 and 8.0 P-1 | .10 |
| 87.80 H-1 and 12.0 P-1 | .20 |
| 99.95 H-2 | .05 |
| 84.90 H-2 and 15.0 P-2 | .10 |
| 84.80 H-2 and 15.0 P-2 | .20 |
| 89.95 H-3 and 10.0 H-5 | .05 |
| 89.90 H-3 and 10.0 P-3 | .10 |
| 84.80 H-3 and 15.0 P-3 | .20 |
| 94.45 H-4 and 5.0 H-5 | .05 |
| 94.40 H-4 and 5.0 P-3 | .10 |
| 92.80 H-4 and 7.0 P-3 | .20 |

EXAMPLE V

This example illustrates that anionic fluorohydrocarbons surfactants can be used in this invention. Example II was repeated using an 1S0 10 naphthenic mineral oil and the candidate anionic and nonionic fluorohydrocarbon surface active agents listed below in Table IV. Zonyl FSN and Zonyl FSO are $F(CF_2CF_2)_{3-8}$ —$CH_2CH_2O(CH_2CH_2O)_xH$ having different levels of oxyethylene units. In the Table AN stands for anionic and NON stands for nonionic.

TABLE IV

| Surfactant | Type | Wt % | Activity |
|---|---|---|---|
| Zonyl FSP | AN | .05 | Partial removal of oil from chip. |
| | | .50 | Complete removal of oil from chip. |
| Zonyl FSA | AN | .05 | None |
| | | .50 | partial removal of oil from chip. |
| Zonyl FSJ | AN | .05 | Complete removal of oil from chip. |
| | | .50 | Complete removal of oil from chip. |
| Zonyl FSN | NON | .05 | None |
| | | .50 | None |
| Zonyl FSO | NON | .05 | None |
| | | .50 | None |

The above data clearly shows that anionic fluorohydrocarbons surfactants are suitable for use in this invention.

COMPARISON EXAMPLE

In an attempt to displace lubricant from chip without using any additive of this invention lubricant compositions comprising mixtures of either 90% by weight mineral oil and 10% by weight polyester or 70% by weight mineral oil and 30% by weight polyester were tested in the manner described in Example II using IS0 10 naphthenic mineral oil and either polyester P-1, which stands for a polyolester of trimethylol propane and 30% valeric acid and P-2, which stands for a polyolester of 2-ethylhexanoic acid, 79% neopentyl glycol and 21% pentaerythritol. The results are set forth below in Table V.

TABLE V

| Polyester | Wt % Polyester | Results |
|---|---|---|
| P-1 | 10% | Oil clings to chip and glass. |
| | 30% | Oil clings to chip and glass. |
| P-2 | 10% | Oil clings to chip and glass. |
| | 30% | Oil clings to chip and glass. |

We claim:

1. A fluid refrigeration composition comprising a mixture of hydrocarbon lubricant(s) and polyol ester lubricant(s) in a weight ratio of polyol ester to hydrocarbon lubricant(s) from about 1:99 to 1:3, a fluorohydrocarbon refrigerant immiscible with the hydrocarbon lubricant(s) which contains at least one carbon atom and all the halogen groups of the fluorohydrocarbon are fluorine, and an effective amount of additive which reduces the interfacial tension at the interface between the hydrocarbon lubricant and refrigerant in liquid form to the point where the spreading coefficient(s) refrigerant liquid on steel is slightly positive enabling the refrigerant to displace hydrocarbon lubricant from steel wherein said additive is present in a concentration of 0.001 to 5 parts by weight per 100 parts by weight lubricant.

2. The composition of claim 1, wherein the hydrocarbon lubricant comprises a paraffinic mineral oil.

3. The composition of claim 1, wherein the hydrocarbon lubricant comprises a naphthenic oil.

4. The composition of claim 1, wherein the hydrocarbon lubricant comprises an alkylbenzene oil.

5. The composition of claim 1, wherein the hydrocarbon lubricant comprises a polyalphaolefin.

6. The composition of claim 1, wherein the hydrocarbon lubricant comprises a major amount of naphthenic mineral oil and a minor amount of an alkylbenzene oil.

7. The composition of claim 1, wherein the hydrocarbon lubricant consists of a paraffinic mineral oil.

8. The composition of claim 1, wherein the fluorohydrocarbon comprises 1,1,1,2-tetrafluoroethane.

9. The composition of claim 1, wherein the fluorohydrocarbon comprises pentafluoroethane.

10. The composition of claim 1, wherein said composition also comprises difluoromonochloromethane.

11. The composition of claim 1, wherein the additive comprises a surfactant.

12. The composition of claim 11, wherein the surfactant comprises 2,4,7,9-tetramethyl-5-decyne-4,7-diol.

13. The composition of claim 1 wherein said lubricant is a mixture of hydrocarbon lubricant and a polyol ester.

14. The composition of claim 11, wherein the surfactant comprises a fluoroester.

15. The composition of claim 11, wherein the surfactant comprises an anionic fluorohydrocarbon.

16. The composition of claim 1, wherein the refrigerant is immiscible over the whole temperature range of −40° C. to 80° C. with the lubricant.

17. A method of retrofitting a compressor system which comprises the step of adding a concentrate comprising a polyol ester lubricant and 2,4,7,9-tetramethyl-5-decyne-4,7-diol to the compressor system.

* * * * *